US010479625B2

(12) United States Patent
Igari et al.

(10) Patent No.: US 10,479,625 B2
(45) Date of Patent: Nov. 19, 2019

(54) SHEET FEEDING APPARATUS AND PRINTING APPARATUS

(71) Applicant: CANON FINETECH NISCA INC., Saitama (JP)

(72) Inventors: Shunsuke Igari, Fuchu (JP); Shinji Toyoshima, Moriya (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/784,311

(22) Filed: Oct. 16, 2017

(65) Prior Publication Data

US 2018/0111771 A1 Apr. 26, 2018

(30) Foreign Application Priority Data

Oct. 20, 2016 (JP) ..... 2016-205844
Mar. 10, 2017 (JP) ..... 2017-046650

(51) Int. Cl.
*B65H 1/04* (2006.01)
*B65H 3/06* (2006.01)
(Continued)

(52) U.S. Cl.
CPC ..... *B65H 1/04* (2013.01); *B41J 13/103* (2013.01); *B65H 3/06* (2013.01); *B65H 7/02* (2013.01);
(Continued)

(58) Field of Classification Search
CPC ..... B65H 2301/41358; B65H 2402/31; B65H 3/5215; B65H 3/46; B65H 3/42;
(Continued)

(56) References Cited

U.S. PATENT DOCUMENTS 5,443,251 A * 8/1995 Kan ..... B65H 3/5215 271/124
2003/0132570 A1 7/2003 Park
(Continued)

FOREIGN PATENT DOCUMENTS

JP 5-193771 A 8/1993
JP 2003-012175 A 1/2003
(Continued)

OTHER PUBLICATIONS

Final Notification of Reasons for Refusal dated Jul. 2, 2019, in Japanese Patent Application No. 2017-046650.

*Primary Examiner* — Howard J Sanders
(74) *Attorney, Agent, or Firm* — Venable LLP

(57) ABSTRACT

A sheet feeding apparatus can perform appropriate separation corresponding to the type of sheet without an actuator which changes the separation action of a separation unit. For this purpose, a separation unit includes a first inclined part and a second inclined part, each having different inclination angles, and selects, in accordance with the type (stiffness, thickness, or the like) of sheet to be fed, either one of the first inclined part or the second inclined part as an inclined part used in separating sheets by lifting/lowering a tray, and separates sheets, so that appropriate separation can be performed in accordance with the type of sheet with a simple configuration.

12 Claims, 14 Drawing Sheets

(51) Int. Cl.

| | |
|---|---|
| ***B41J 13/10*** | (2006.01) |
| ***B65H 7/02*** | (2006.01) |
| *B65H 7/18* | (2006.01) |
| *B65H 3/42* | (2006.01) |

(52) U.S. Cl.
CPC ..... *B65H 3/42* (2013.01); *B65H 7/18* (2013.01); *B65H 2220/02* (2013.01); *B65H 2301/42324* (2013.01); *B65H 2511/152* (2013.01); *B65H 2511/416* (2013.01)

(58) Field of Classification Search
CPC ..... B65H 2301/3322; B65H 2301/342; B65H 2301/3421
See application file for complete search history.

(56) References Cited

U.S. PATENT DOCUMENTS

| | | | | |
|---|---|---|---|---|
| 2007/0063423 | A1* | 3/2007 | Kirby ..... | B65H 1/12 271/126 |
| 2009/0230608 | A1* | 9/2009 | Kimura ..... | B65H 1/08 271/10.01 |

FOREIGN PATENT DOCUMENTS

| | | | |
|---|---|---|---|
| JP | 2006-298541 | A | 11/2006 |
| JP | 2008-150167 | A | 7/2008 |
| JP | 2014-210644 | A | 11/2014 |
| JP | 2014-237499 | A | 12/2014 |

* cited by examiner

| FIG.9A |
| --- |
| FIG.9B |

| FIG.11A | |
|---|---|
| | FIG.11B |

SHEET FEEDING APPARATUS AND PRINTING APPARATUS

BACKGROUND OF THE INVENTION

Field of the Invention

The present invention relates to a sheet feeding apparatus and a printing apparatus which separate one-by-one the sheets stacked on a tray, a cassette, or the like, and feed the separated sheet to an adjacent processing apparatus.

Description of the Related Art

Conventionally, there is known a feeding apparatus mounted on, for example, a printing apparatus, such as an inkjet printing apparatus or an electrophotographic-type printing apparatus, the feeding apparatus having a plurality of sheets each serving as print media placed in a bundle form on a tray, a cassette, or the like (hereinafter, simply referred to as a tray), and separating the sheets one-by-one to feed the separated sheet to a printing unit or the like. This feeding apparatus sequentially feeds out sheets from the uppermost sheet with a pickup roller facing the stacking surface of a tray, and feeds the same to a processing position on the downstream side thereof. The examples of the scheme for separating sheets include a scheme for separating sheets by causing a front edge of a sheet to abut to an inclined part, and a scheme for separating sheets by causing sheets to pass between a feed roller and a friction member. Because these schemes have a simple configuration, these may be combined to improve separability. In this case, the feeding apparatus includes an inclined guide member which is arranged at a downstream side tip of a tray and pre-handles the sequentially fed sheets, a feeding roller connected to the inclined guide member, and a separation member (roller, belt, etc.) which abuts to this feeding roller and separates sheets with a frictional force.

In the feeding apparatus, a sheet separation/feed mechanism may be provided so as to stably feed the sheet on a tray without being skewed. The sheet separation/feed mechanism includes a reference wall for correcting a skew by causing a side edge of a sheet to abut to the reference wall, an oblique-feed roller for causing a sheet to abut against the reference wall, and the like.

On the other hand, depending on the types and states, such as the quality of material, thickness, and moisture content (hereinafter, these are referred to as the conditions of a sheet), of a sheet to feed, a problem, such as jam, double feed, or misfeed, may be likely to occur during feeding. In order to cope with this problem, it may be desirable to make variable relative positions of the components of the sheet separation/feed mechanism and feed in accordance with the type and state of a sheet.

Then, Japanese Patent Laid-Open No. 2014-237499 discloses a feed mechanism which checks the feeding state of a sheet, and changes the angle of an inclined part which separates sheets by causing the sheets to abut thereto, based on the feeding state and corresponding to the various sheets.

However, in the configuration proposed in Japanese Patent Laid-Open No. 2014-237499, the angle of an inclined part which separates sheets by causing the sheets to abut thereto is changed corresponding to the conditions (type and state) of a sheet, but the angle needs to be changed using a power source, such as a motor or an actuator. In a case where such a power source is used, an increase in cost and/or an increase in size of a product will be caused.

SUMMARY OF THE INVENTION

Accordingly, the present invention enables sheets to be separated with a simple configuration.

To this end, a sheet feeding apparatus of the present invention includes: a stacking unit capable of stacking sheets; a feed unit configured to feed the sheets stacked on the stacking unit; a separation unit for separating a sheet to feed from another sheet in feeding sheets with the feed unit, the separation unit including a plurality of separation parts each having different actions onto a sheet when the sheet first abuts thereto; and a change unit configured to change a separation part to which a sheet abuts among the plurality of separation parts by changing the position of the stacking unit.

According to the present invention, sheets can be separated with a simple configuration.

Further features of the present invention will become apparent from the following description of exemplary embodiments with reference to the attached drawings.

DESCRIPTION OF THE EMBODIMENTS

First Embodiment

Hereinafter, a first embodiment of the present invention will be described with reference to the drawings.

First, the basic configuration of a feed mechanism according to the present embodiment will be explained.

Figure 1:
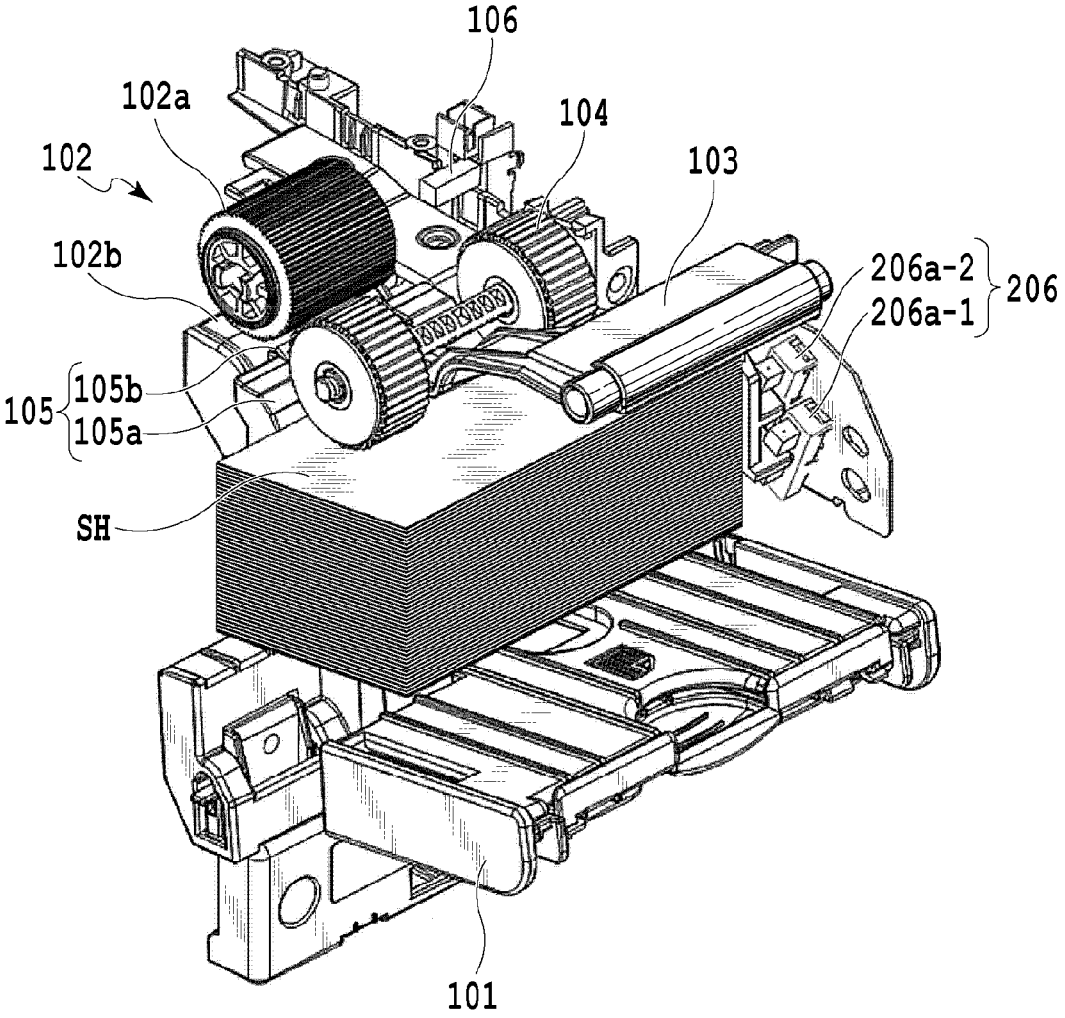
FIG. 1 is a perspective view illustrating the whole configuration of a feeding apparatus according to a first embodiment.

FIG. 1 is a perspective view illustrating the whole configuration of the feeding apparatus according to the present embodiment. The feeding apparatus according to the present embodiment is mounted on an inkjet printing apparatus, and includes a tray 101 which is a stacking unit configured to stack sheets which are print media. Moreover, the feeding apparatus includes a separation/feed unit 102 configured to separate and feed sheets one by one to the downstream side (downstream side in the feeding direction) of the tray 101. This separation/feed unit 102 includes a separation roller 102*a* and a separation pad 102*b* which frictionally engages with this separation roller 102*a* and prevents the double feed of a sheet and subsequent sheet. Moreover, the tray 101 is configured to be capable of being elevated and stopped at a predetermined position by means of a tray elevating unit 209 (see FIG. 2 described later) and a tray position detection sensor 210 (see FIG. 2 described later). Moreover, an elevated position detection lever 103 which detects an initial position state of the tray position detection sensor 210 and the position of the uppermost sheet is arranged above the tray 101.

Above the tray 101, a pickup roller 104 is arranged which feeds out a sheet positioned at the highest position (hereinafter, the uppermost sheet) in a stacked sheet bundle sequentially toward the separation roller 102*a*. Moreover, between this pickup roller 104 and the separation roller 102*a*, there is arranged a separation unit 105 which handles a front edge of a sheet. This separation unit 105 includes an inclined part 105*a* provided with a smooth part which guides a front edge of a sheet picked up by the pickup roller 104 to the separation/feed unit 102; and a friction part 105*b*, in an area on the downstream side in the feeding direction of the inclined part 105*a*, which increases the frictional resistance against a sheet. The inclined part 105*a* is configured as an inclined plane which lifts, in the feeding direction, a front edge of a sheet fed by the pickup roller 104. A sheet detection sensor 106 is arranged on the downstream side of a position where sheets are separated by the separation/feed unit 102, and the sheet detection position detected by the sheet detection sensor 106 is located downstream of the position where sheets are separated by the separation/feed unit 102. This sheet detection sensor 106 detects a sheet transit time, an interval between a preceding sheet and the subsequent sheet, etc. The details of this sheet detection part will be described later. Moreover, although not illustrated in FIG. 1, the sheet separated by the separation/feed unit 102 is fed to a printing unit etc., by a feed unit arranged downstream of the separation/feed unit 102.

In such a configuration, the uppermost sheet of a sheet bundle mounted on the tray 101 is fed toward the separation roller 102*a* by the pickup roller 104. In this case, a front edge of the sheet is fed in the lifting direction along the inclined part 105*a* provided in the separation unit 105, the inclined part 105*a* being configured so that an inclination angle relative to the stacked sheets increases toward the downstream in the feeding direction, and the front edge of the uppermost sheet and a front edge of its lower sheet are handled and separated by the inclined part 105*a*. The action of this separation unit 105 reduces the possibility of double feed of the sheets fed between the separation roller 102*a* and the separation pad 102*b*.

Figure 2:
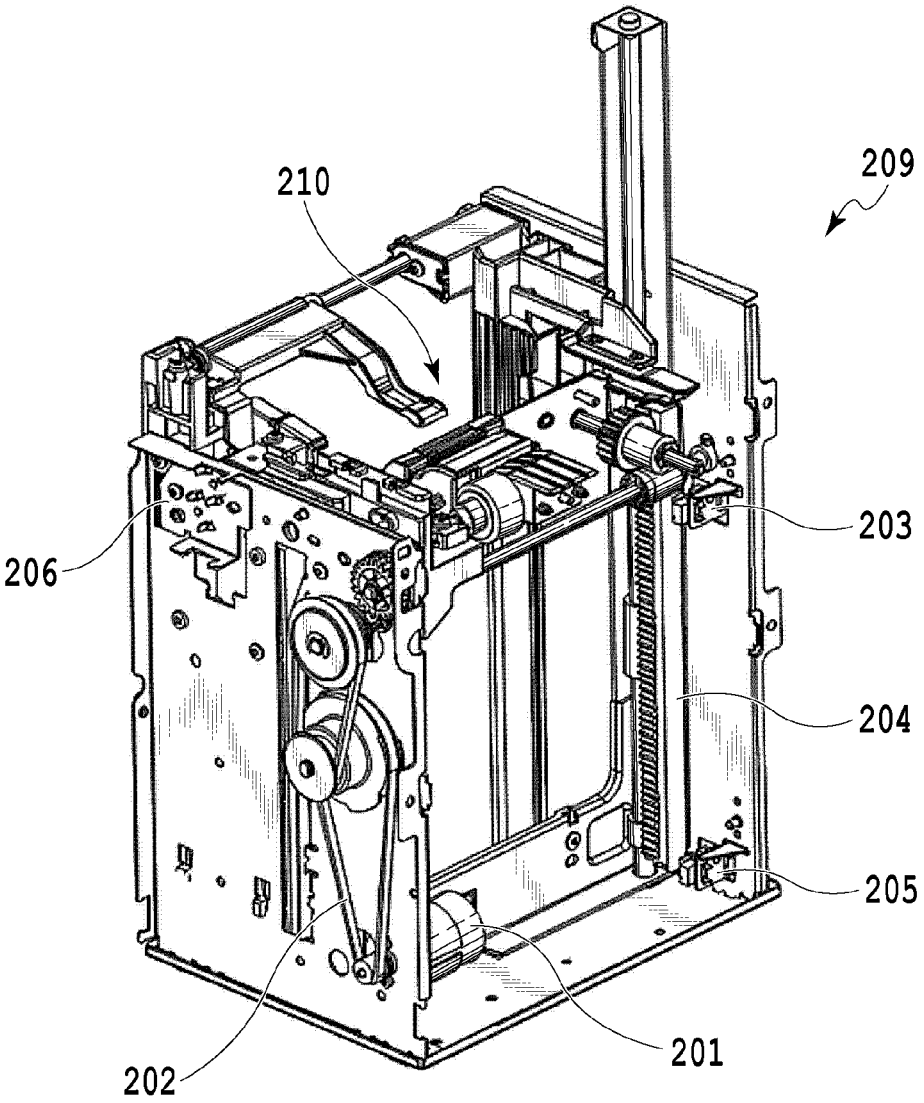
FIG. 2 is a perspective view illustrating the configuration of a tray elevating unit in FIG. 1.

Next, the tray elevating unit 209 will be explained. FIG. 2 illustrates a configuration of the tray elevating unit 209.

The tray elevating unit 209 includes a tray motor 201, which is the drive source of the elevating operations of the tray 101, and a tray drive transmission part 202 (here, a transmission mechanism including a belt and a gear) configured to transmit the rotational motion from the tray motor 201. Moreover, the tray elevating unit 209 includes a rack-and-pinion mechanism 204 for connecting the tray drive transmission part 202 and the tray 101. A rack part of the rack-and-pinion mechanism 204 and the tray 101 are integrally and movably configured, and the rack part is configured to be lifted or lowered integrally with the tray 101 depending on the rotation direction of the tray motor 201. Moreover, the tray 101 is provided so as to be elevated in accordance with an instruction from a control apparatus 502 (described later) and by the operation of the rack-and-pinion mechanism 204. Furthermore, the tray 101 is configured to be movable between an upper limit position which is detected by a tray upper limit position detection sensor 203 when the tray 101 is lifted, and a tray lower limit position detection sensor 205 provided in the vicinity of the rack part of the rack-and-pinion mechanism 204 and configured to detect a lower limit position of the tray 101.

The feeding apparatus according to the present embodiment is capable of detecting a top-face position of a sheet bundle stacked on the tray 101 and a top-face position of the tray 101 having no sheet stacked thereon. For the purpose of detecting these positions, there is provided the elevated position detection lever 103 which abuts to the uppermost sheet of the sheets stacked on the tray 101, the sheets being elevated by the tray elevating unit 209, or to the top face of the tray 101 and rotates in the vertical direction, corresponding to the position of the tray 101. Furthermore, the feeding apparatus according to the present embodiment includes an elevated position detection sensor 206 for detecting whether or not the elevated position detection lever 103, which is caused to rotate by a sheet or the tray 101, has been pushed up to a predetermined position. Then, the control apparatus 502 (described later) detects, based on the detection result of the elevated position detection sensor 206, whether or not the top-face position of sheets or the top-face position of the tray 101 is located at a predetermined position.

Next, the details of the separation unit 105 and the elevated position detection lever 103 in the present embodiment will be explained.

Figure 3:
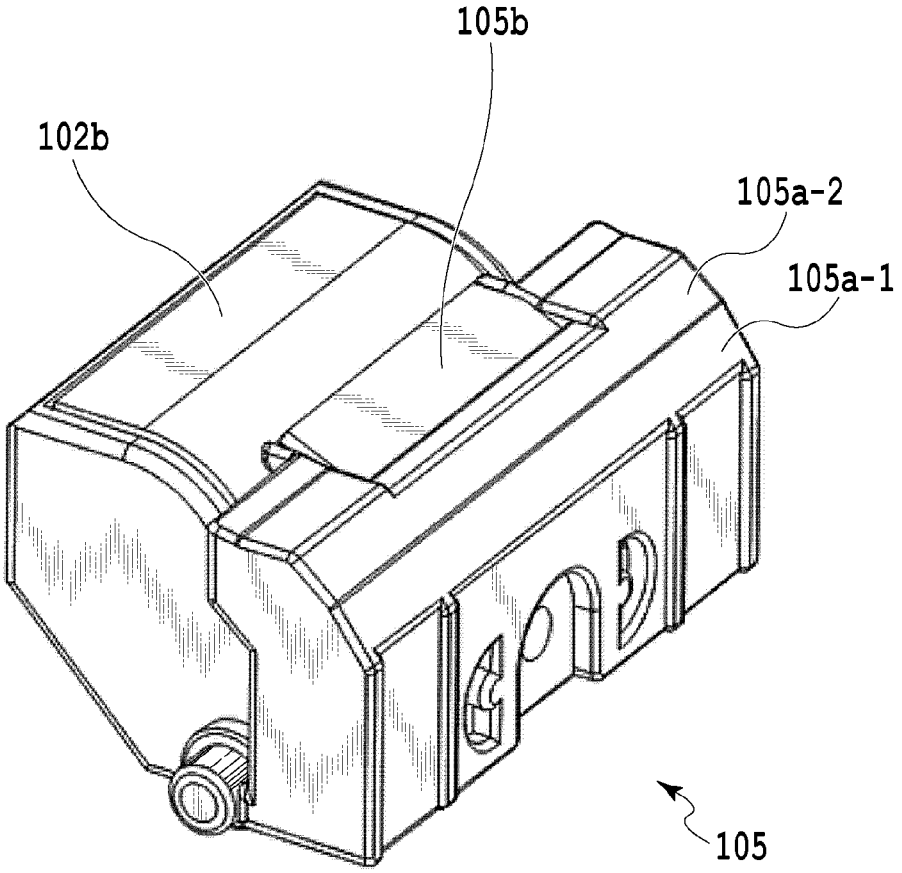
FIG. 3 is a perspective view illustrating a separation unit of the feeding apparatus according to the first embodiment.
Figure 4:
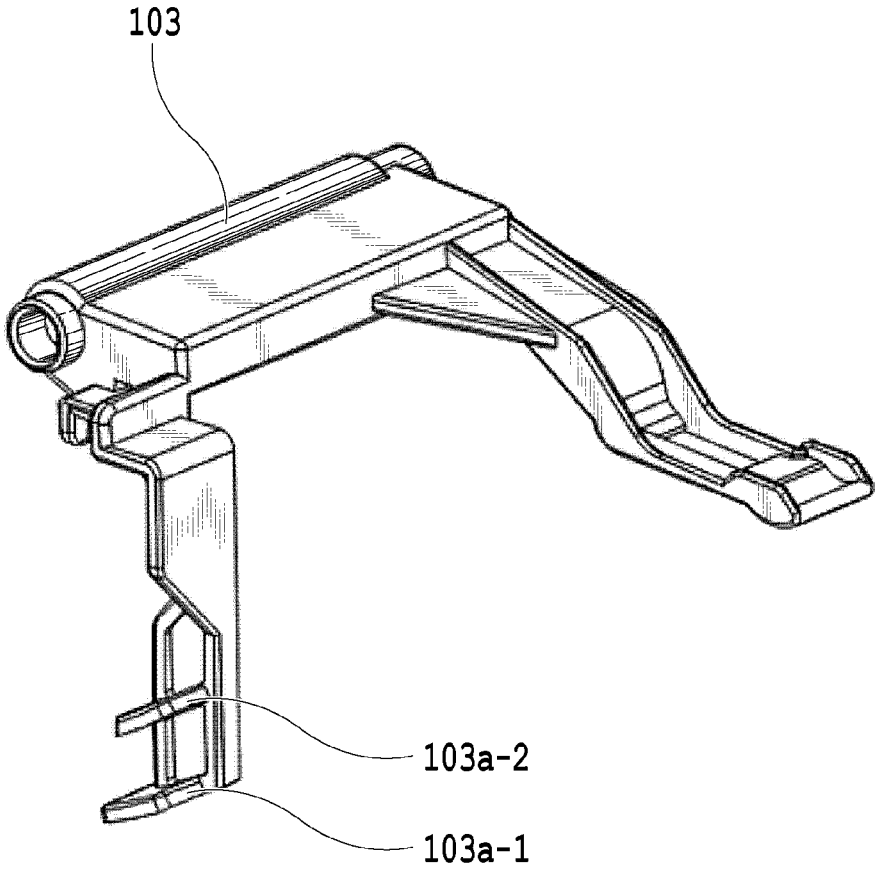
FIG. 4 illustrates an elevated position detection lever of the feeding apparatus according to the first embodiment.

FIG. 3 illustrates the details of the separation unit 105 of the feeding apparatus in the present embodiment. Moreover, FIG. 4 illustrates the details of the elevated position detection lever 103 of the feeding apparatus in the present embodiment.

The separation unit 105 includes the plurality of inclined parts 105*a* each having different inclination angles, and includes, in the present embodiment, a first inclined part 105*a*-1 and a second inclined part 105*a*-2 each having different inclination angles. The inclined parts are thus made different from each other, and thereby a separation action onto a sheet when the sheet abuts to the inclined part is made different between the first inclined part 105*a*-1 and the second inclined part 105*a*-2. Furthermore, an area on the downstream side in the feeding direction of this inclined part

105*a* includes the friction part 105*b* for increasing the frictional resistance against a sheet. The inclined part 105*a* is configured as an inclined plane for lifting, in the feeding direction, a front edge of a sheet fed by the pickup roller 104.

Moreover, the elevated position detection lever 103 includes a plurality of elevated position detection flags for switching the elevated positions, and includes, in the present embodiment, a first elevated position detection flag 103*a*-1 and a second elevated position detection flag 103*a*-2. Furthermore, in the present embodiment, as illustrated in FIG. 1, the elevated position detection sensor 206 includes a first elevated position detection sensor 206*a*-1 for detecting a first elevated position and a second elevated position detection sensor 206*a*-2 for detecting a second elevated position. Thus, the top-face position of a sheet bundle stacked on the tray 101 can be switched between two levels in accordance with the sheet conditions. In this case, if a sensor is used which can accurately detect the height of the top-face position of the sheets stacked on the tray 101, the tray 101 may be elevated so that the detected top-face position becomes the first elevated position or the second elevated position.

Figure 5:
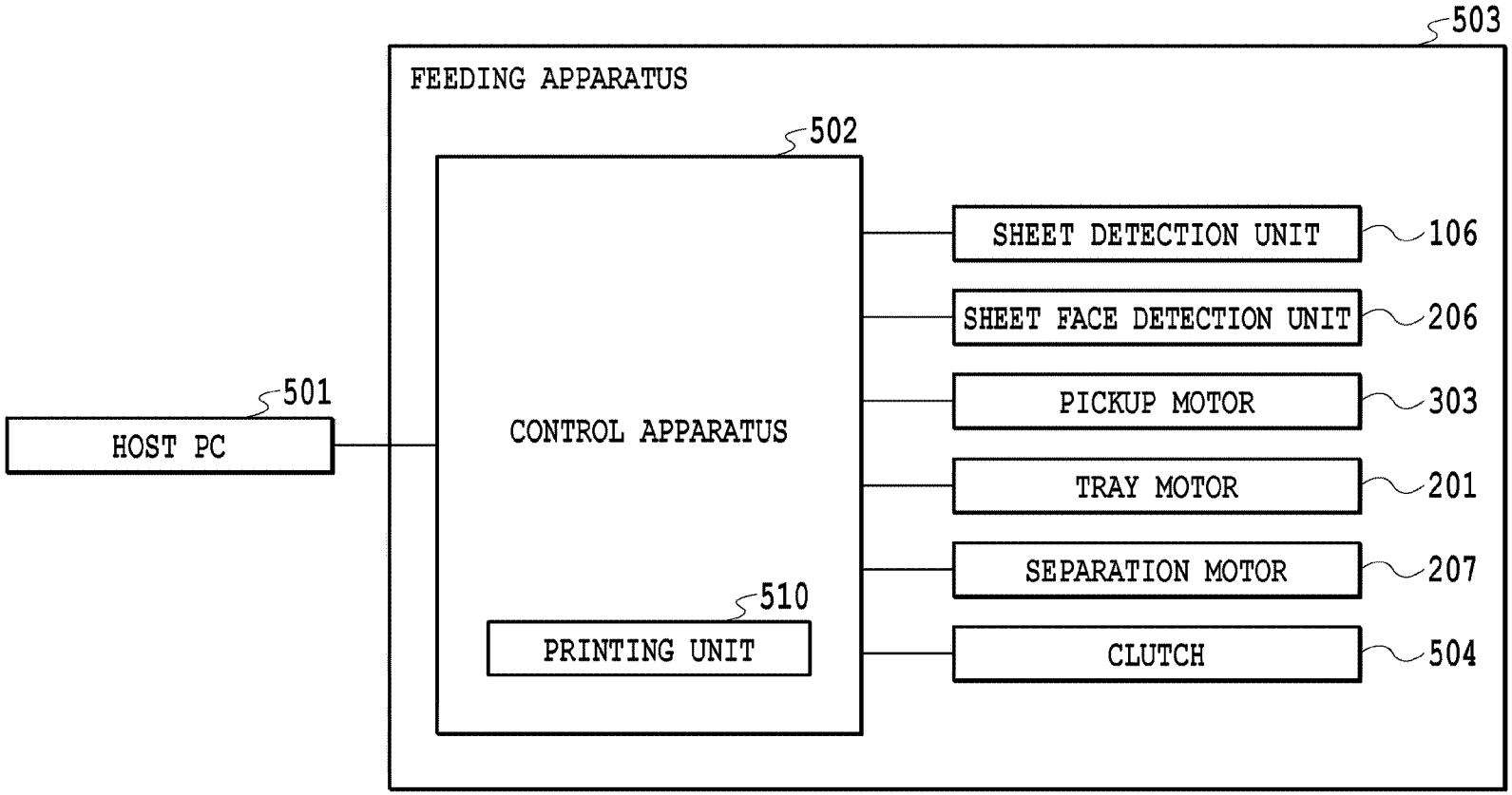
FIG. 5 is a block diagram illustrating the configuration of the feeding apparatus according to the first embodiment.

FIG. 5 is a block diagram illustrating the configuration of a feeding apparatus 503 according to the present embodiment. The feeding apparatus 503 includes the control apparatus 502 which executes the general control of the feeding apparatus 503. The control apparatus 502 executes a feed operation based on the information (information, such as feed execution/stop instructions and the sheet conditions) transmitted from a host PC 501 which is an external apparatus. The tray motor 201, the sheet detection sensor 106, a separation motor 207, a pickup motor 303, the elevated position detection sensor 206, and a clutch 504 are connected to the control apparatus 502. The control apparatus 502 also includes a printing unit 510. The control apparatus 502 is configured to control the tray motor 201, the separation motor 207, the pickup motor 303, and the clutch 504 based on the detection result of the sheet detection sensor 106 and/or elevated position detection sensor 206.

The control apparatus 502 executes flow charts of FIG. 6, FIG. 9A, FIG. 9B, FIG. 11A and FIG. 11B (described later) In the feeding apparatus 503 of the present embodiment, the host PC 501 which is an external apparatus is used as a unit configured to provide information on feed execution/stop instructions and the sheet conditions, but the present invention is not limited thereto, and this unit may be provided integrally with the feeding apparatus 503. Note that the pickup motor 303 is configured to be capable of driving the pickup roller 104 which performs a sheet pickup operation and the separation roller 102*a* which separates and feeds sheets. Moreover, the clutch 504 is provided between the pickup motor 303 and the pickup roller 104. The control apparatus 502 can simultaneously rotate the pickup roller 104 and separation roller 102*a* by turning on the clutch 504, and rotate the separation roller 102*a* without rotating the pickup roller 104 by turning off the clutch 504.

Figure 6:
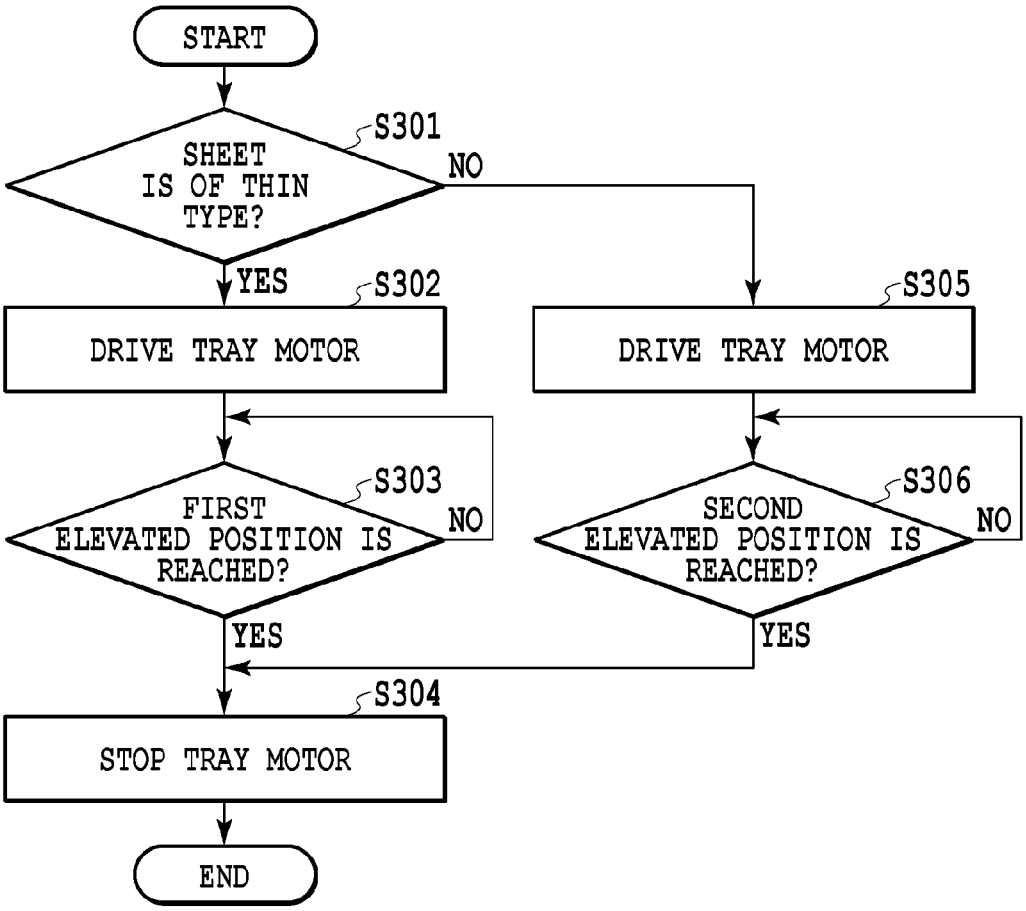
FIG. 6 is a flow chart illustrating a feed position switching operation of the feeding apparatus according to the first embodiment.
Figure 7A:
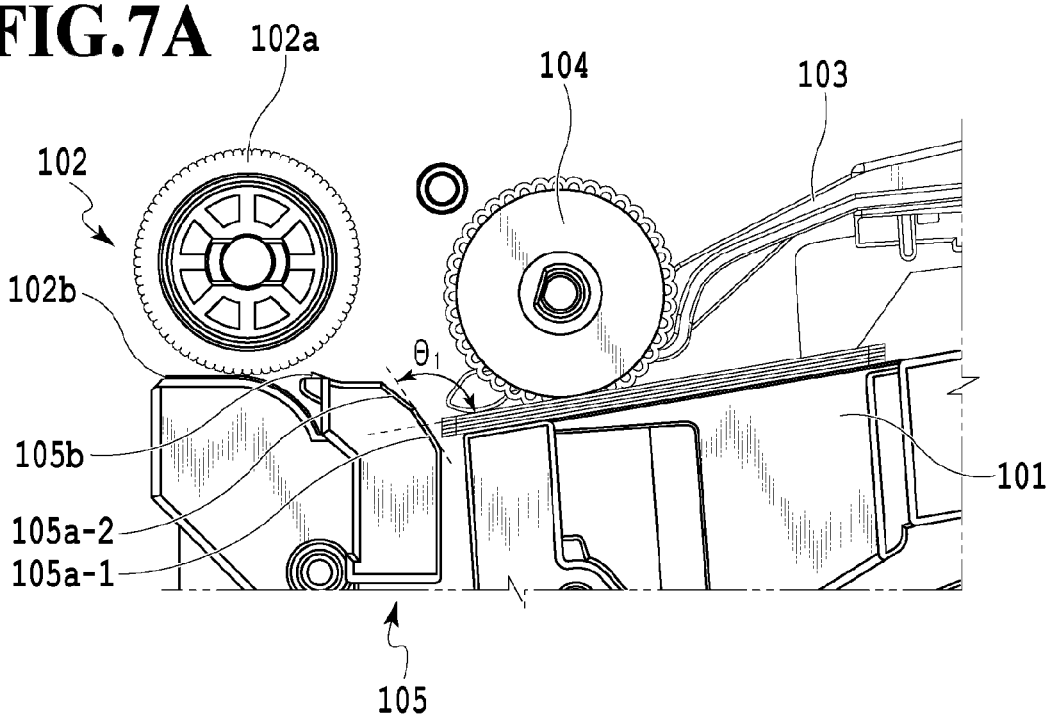
FIG. 7A is a schematic cross sectional view of a first elevated position indicative of a feed position and a feed angle.
Figure 7B:
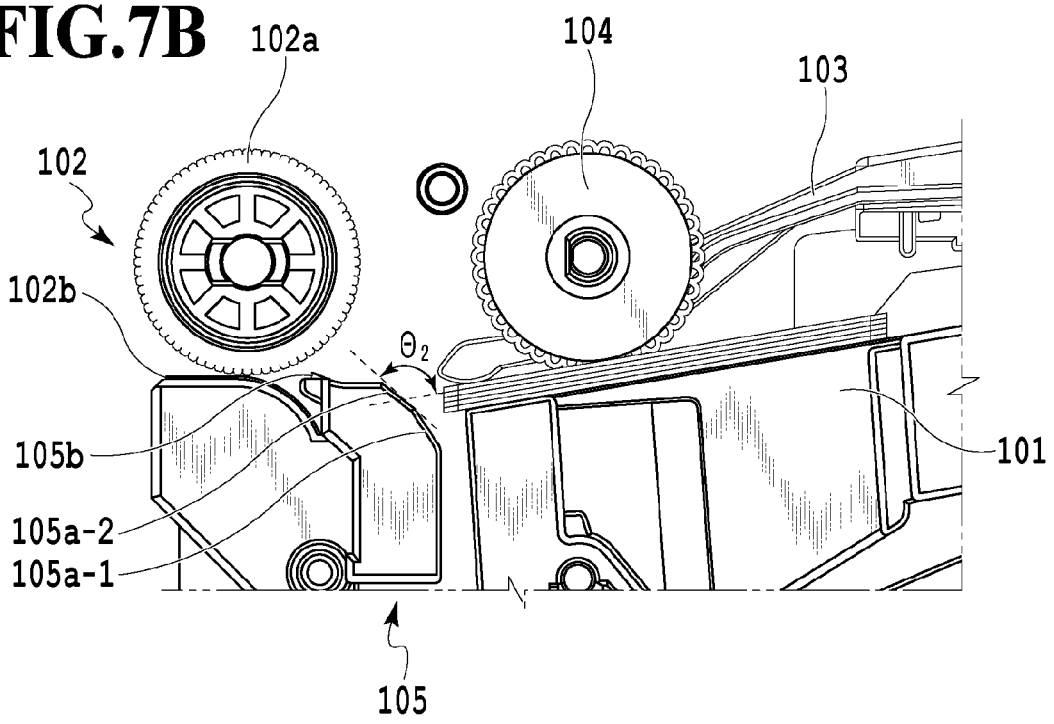
FIG. 7B is a schematic cross sectional view of a second elevated position indicative of a feed position and a feed angle.

FIG. 6 is a flow chart illustrating the feed position switching operation of the feeding apparatus according to the present embodiment. Hereinafter, the operation to switch the feed position of the tray will be explained in accordance with this flow chart. Moreover, FIG. 7A and FIG. 7B illustrate the details of the feed position and feed angle after being switched by the feed position switching operation, in which FIG. 7A illustrates the details of a first feed position and FIG. 7B illustrates the details of a second feed position.

Upon start of the feed position switching operation, first in Step 301, the control apparatus 502 determines whether or not a sheet is a thin sheet, based on the data about the sheet conditions provided from the host PC 501. Here, a sheet, such as a business card or a postcard, whose sheet thickness is on the order of 0.2 to 0.5 mm is determined as a thin sheet, and in the case of a thin sheet, the feed operation is performed at a first elevated position. Moreover, a sheet, such as a thick business-card or plastic card, whose sheet thickness is on the order of 0.5 to 0.8 mm is determined as a thick sheet, and in the case of a thick sheet, the feed operation is performed at a second elevated position. That is, in the present embodiment, the type of a sheet is classified based on the thickness, and with 0.5 mm as a threshold, a sheet whose sheet thickness is less than 0.5 mm is determined as a thin sheet, while a sheet whose sheet thickness is equal to or greater than 0.5 mm is determined as a thick sheet. Moreover, in the above, the type of a sheet is classified by the thickness, but it may be classified by the basis weight of a sheet not by the thickness.

If the determination in step S301 is affirmative, the flow proceeds to step S302, in which the tray motor 201 is driven so as to move the tray to the first elevated position. On the other hand, if the determination is negative (i.e., if the sheet is determined as a thick sheet), the flow proceeds to step S305, in which the tray motor 201 is driven so as to move the tray to the second elevated position.

In step S302, the tray motor 201 is driven to move the tray 101, and then in Step S303, it is determined whether the first elevated position has been detected. If this determination is affirmative, the flow proceeds to step S304, in which the tray motor 201 is stopped to end the flow. On the other hand, if the determination is negative, step S303 will be repeated until the determination becomes affirmative. The state in which this tray is stopped at the first elevated position is illustrated in FIG. 7A. Here, the feed operation is executed after a front edge of a sheet fed from the first elevated position is caused to abut to the first inclined part 105*a*-1 of the separation unit 105. Here, the angle formed by the first inclined part 105*a*-1 and the uppermost sheet is designated by θ1. This feed angle θ1 is set to a predetermined angle in consideration of the conditions of a sheet (the type, stiffness, etc., of a sheet). The pickup roller 104 is waiting in contact with a sheet. Upon execution of feeding, the pickup motor 303 is driven to rotate the pickup roller 104. Then, the sheets are fed one-by-one from the uppermost sheet of a sheet bundle stacked on the tray 101 to the separation/feed unit 102, the clutch 504 is turned on, and the separation roller 102*a* of the separation/feed unit 102 rotates simultaneously with the pickup roller 104 and feeds the sheets.

Moreover, if negative determination is made instep S301, the flow proceeds to step S305. Here, the tray motor 201 is driven to move the tray 101, and then in Step S306 it is determined whether the second elevated position has been detected. If this determination is affirmative, the flow proceeds to step S304, in which the tray motor 201 is stopped to end the flow. On the other hand, if the determination is negative, step S306 will be repeated until the determination becomes affirmative. The state in which this tray is stopped at the second elevated position is illustrated in FIG. 7B. The feed operation is executed after a front edge of a sheet fed from the second elevated position is caused to abut to the second inclined part 105*a*-2 of the separation unit 105. Here, the angle formed by the second inclined part 105*a*-2 and the uppermost sheet is designated by θ2. This feed angle θ2 is set to a predetermined angle in consideration of the type, stiffness, etc. of a sheet, and is larger than the first feed angle θ1. The control apparatus 502 can perform a stable feed operation of both a thin sheet and a thick sheet by switching the feed positions, based on the result of this sheet determining unit.

With the above configuration and control, in the feeding apparatus of the present embodiment a stable feed operation can be performed by moving the elevated position to the optimal feed position corresponding to the type of a sheet. Thus, the possibility of feed troubles, such as double feed and/or misfeed, can be suppressed.

Second Embodiment

Hereinafter, a second embodiment of the present invention will be explained with reference to the drawings.

Note that a part having the same configuration as the above-described first embodiment is given the same reference sign to omit the explanation thereof.

The sheet detection sensor 106 in the present embodiment will be explained. The sheet detection sensor 106 is arranged, as illustrated in FIG. 1, substantially parallel to the position where sheets are separated by the separation/feed unit 102. In the present embodiment, a transmission sensor (hereinafter, simply sensor) is used as the detection sensor, and the sensor is configured so as to be in a light shielding state while a sheet is passing therethrough.

Figure 8:
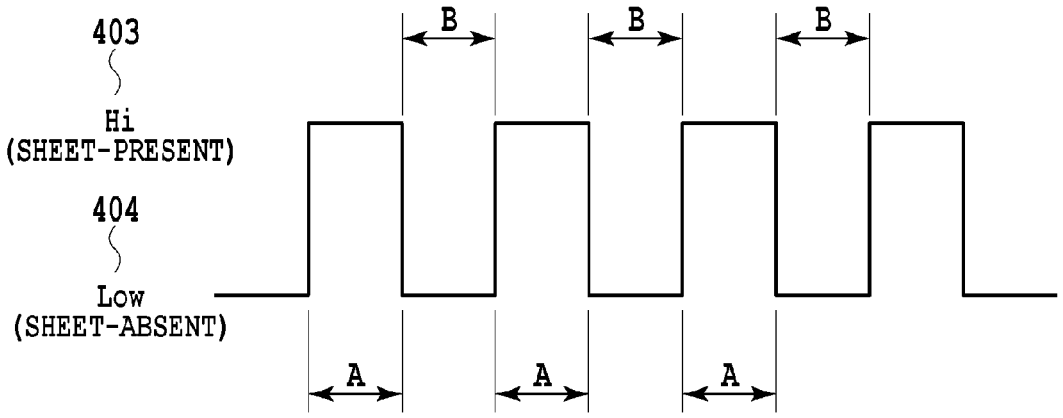
FIG. 8 schematically illustrates a detection state of a sheet detection sensor.

FIG. 8 schematically illustrates an output result of the sheet detection sensor 106 while sheets are fed. Once a sheet is fed, the output of the sensor becomes a "sheet-present" level 403 (hereinafter, referred to as also a Hi level), and once the sheet has passed therethrough, the output of the sensor becomes a "sheet-absent" level 404 (hereinafter, referred to as also a Low level). A time A in the view represents a sheet transit time, and is a time elapsed after a sheet is fed and the sensor detects a front edge of the sheet and until the sensor detects a rear edge of the sheet. A time B in the view corresponds to an interval in the feeding direction between a preceding sheet and the subsequent sheet. The control apparatus 502 detects the sheet transit time and the sheet interval, based on such an output result of the sheet detection sensor 106.

Figures 9, 9A:
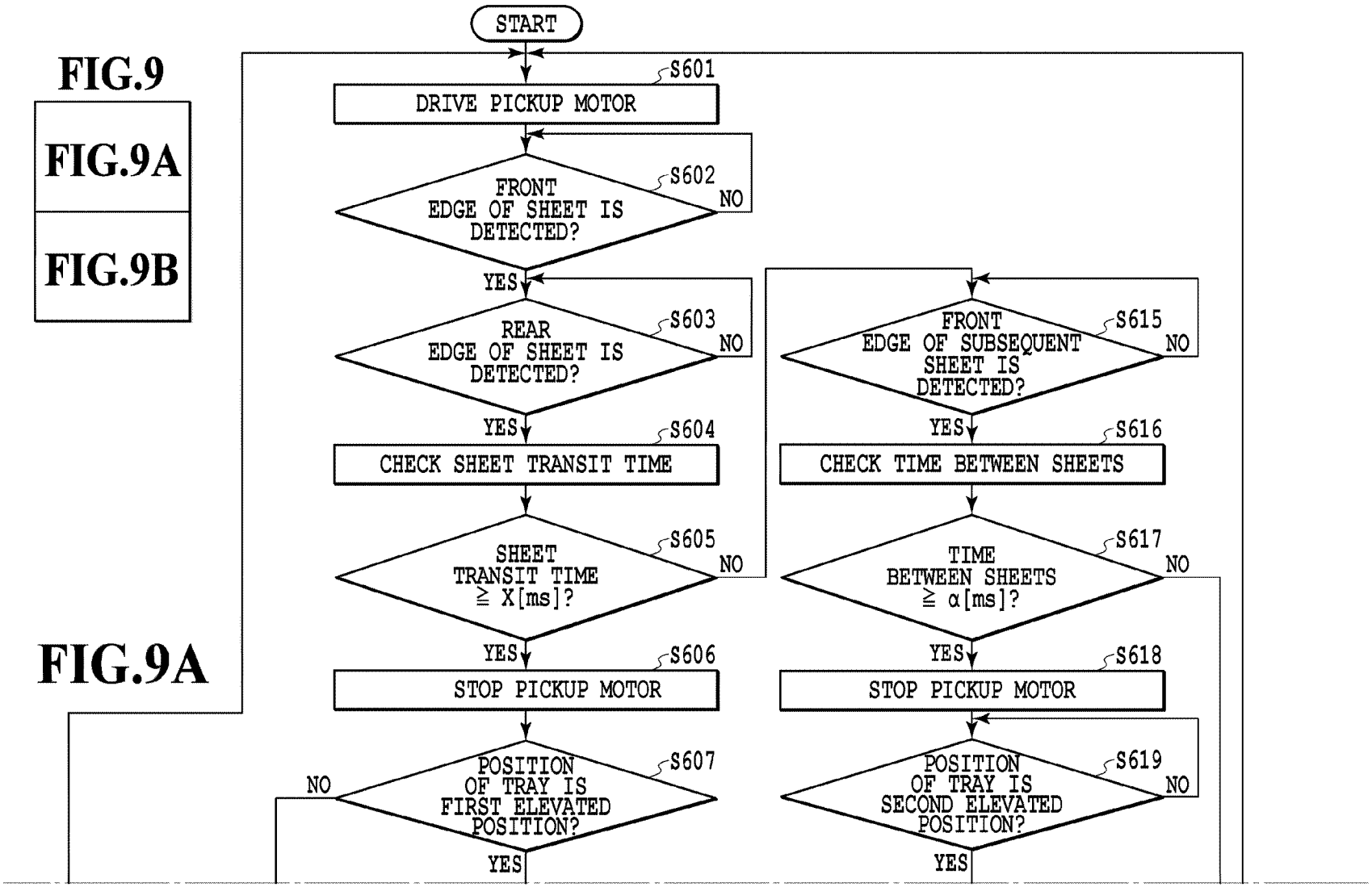
FIG. 9 is a diagram showing the relationship of FIG. 9A and FIG. 9B.
FIG. 9A is a flow chart illustrating feed processing in a feeding apparatus according to a second embodiment.
Figure 9B:
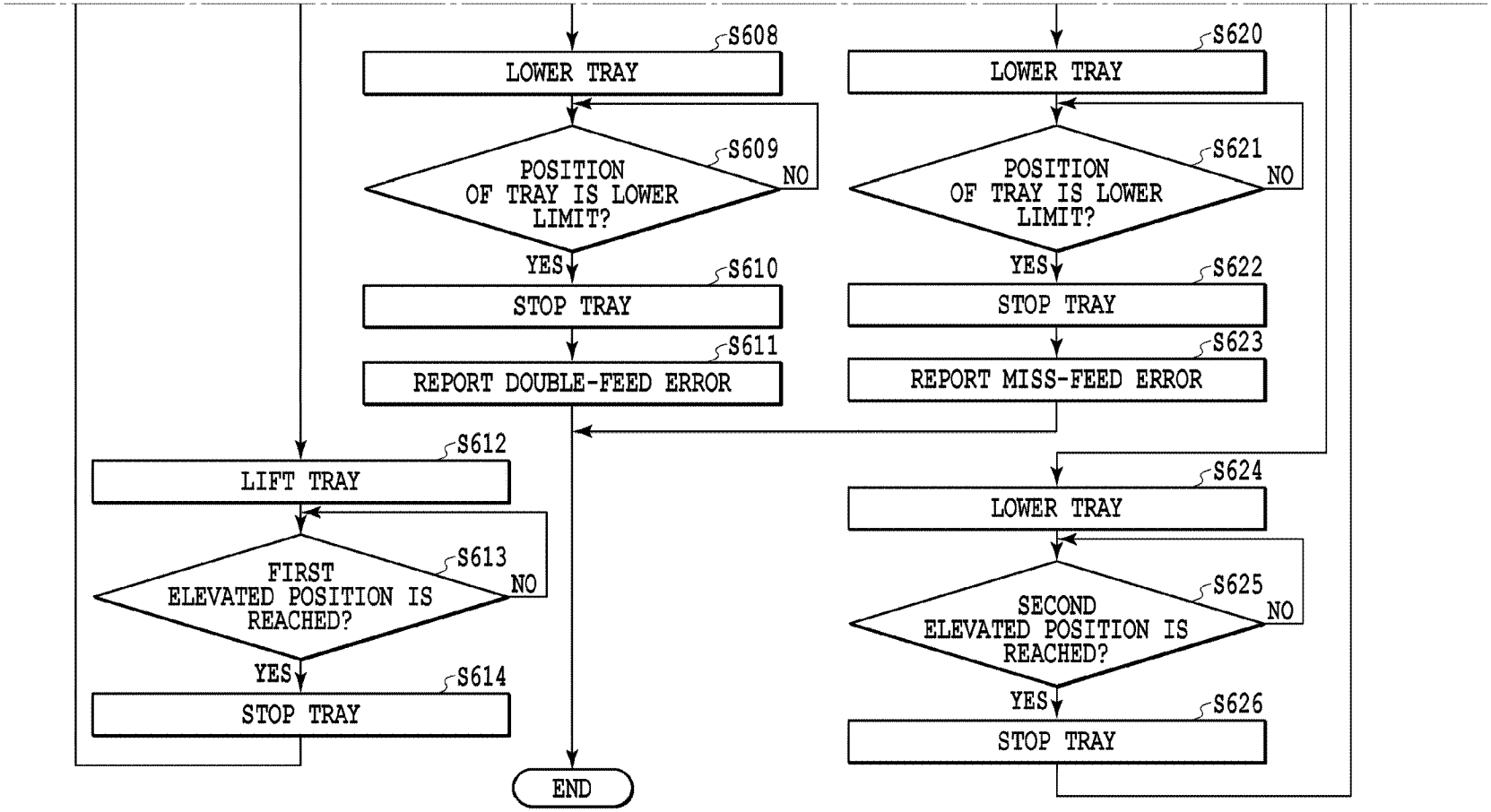
FIG. 9B is a flow chart illustrating feed processing in a feeding apparatus according to a second embodiment.

FIG. 9A and FIG. 9B are flow charts illustrating a feed processing procedure in the feeding apparatus of the present embodiment. Hereinafter, the characteristic feed processing of the present embodiment will be explained in accordance with this flow chart.

First, when the control apparatus 502 receives a feed execution instruction transmitted from the host PC 501, the feed procedure starts. The control apparatus 502 moves the position of the tray 101 to the first elevated position, based on the information corresponding to the tray position stored in a storage unit. Subsequently, the control apparatus 502 causes the pickup motor 303 to be driven and turns on the clutch 504 to start feeding of sheets, in step S601.

In step S602, it is determined whether or not the sheet detection sensor 106 has detected a front edge of the fed sheet (i.e., whether or not the output of the sheet detection sensor 106 has become a Hi level), and if the determination is affirmative, the flow proceeds to step S603. If the determination is negative, step S602 will be repeated until the determination becomes affirmative.

Next, in step S603, it is determined whether or not the sheet detection sensor 106 has detected a rear edge of the sheet (i.e., whether or not the output of the sheet detection sensor 106 has become a Low level). A time required for this output to transition from a Hi level to a Low level, i.e., a time between a time point at which a front edge of a sheet is detected and a time point at which a rear edge of the sheet is detected, is checked as the transit time of the sheet, in step S604.

Next, it is determined whether or not the sheet transit time checked in step S604 is equal to or greater than a predetermined time X, in step S605. Note that, the predetermined time period to be compared with the sheet transit time is set by adding values, such as a feeding error and a measurement error, to a value obtained by dividing a length of a sheet in the feeding direction by the feed speed of a sheet to be fed.

In step S605, a case where the determination is affirmative (transit time≥X) is for example a case where a rear edge of a preceding sheet and a front edge of the subsequent sheet overlap and the sheet detection sensor 106 continues to indicate the presence of a sheet. That is, this is the case where sheet separation is insufficient. Then, the control apparatus 502 determines that this is a double-feed state. In this case, the control apparatus 502 stops the pickup motor 303 in step S606, and then in step S607 determines whether or not the position of the tray 101 is the first elevated position. If the determination is affirmative, then in step S608 the tray motor 201 is driven to start lowering the tray 101, and then in step S609 the tray 101 will be lowered until the sensor detects that the position of the tray 101 is a lower limit. If the determination is affirmative in step S609, the driving of the tray motor 201 is stopped in step S610, and the occurrence of double feed is reported to the host PC 501 instep S611 and then the feed operation is ended.

Moreover, if the determination is negative in step S607, the tray motor 201 is driven to start lifting the tray 101 in S612, and the tray 101 will be lifted until it is detected in step S613 that the tray 101 is at the first elevated position. If the determination is affirmative in step S613, the driving of the tray motor 201 is stopped instep S614, and the flow from S601 and thereafter will be performed again.

Moreover, in step S605, a case where the determination is negative (transit time<X) is a case where the double feed of a preceding sheet and the subsequent sheet has not occurred and thus the control apparatus 502 causes the feed operation to be continued. That is, the control apparatus 502 turns on the clutch 504 so as to be able to start feeding a sheet in a predetermined time after the sheet detection sensor 106 detected a rear edge of the preceding sheet, thereby causing the feeding of the subsequent sheet to be started. Then, in step S615, it is determined whether or not the sheet detection sensor 106 has detected a front edge of the subsequent sheet (i.e., whether or not the output of the sheet detection sensor 106 has become a Hi level). If the determination is affirmative, the flow proceeds to step S616. If the determination is negative, S615 will be repeated until the determination becomes affirmative. Upon detection of a front edge of the subsequent sheet, the control apparatus 502 checks the time between a preceding sheet and the subsequent sheet in step S616. That is, checked is a time elapsed after the sheet detection sensor 106 detected a rear edge of the preceding sheet and until it detects a front edge of the subsequent sheet.

Next, in step S617, it is determined whether or not the checked time interval between sheets is equal to or greater than a predetermined time $\alpha$.

Here, if the determination is negative, the procedure is ended, while if the determination is affirmative (time interval between sheets≥$\alpha$), the following processing is performed. Here, the case where the control apparatus 502 makes the affirmative determination is a state in which the interval between the preceding sheet and the subsequent sheet is wide, the load due to a reaction force which a front edge of a sheet receives from the inclined part of the separation unit 105 is large, and thus it is likely to misfeed.

Then, the control apparatus 502 stops the pickup motor 303 in step S618, and then in step S619 it is determined whether or not the position of the tray 101 is the second elevated position. If the determination is affirmative, then in step S620 the tray motor 201 is driven to start lowering the tray 101, and then in step S621 the tray 101 will be lowered until the sensor detects that the position of the tray 101 is a lower limit. If the determination is affirmative in step S621, then in step S622 the driving of the tray motor 201 is stopped, and the occurrence of misfeed is reported to the host PC 501 in step S623 and then the feed operation is ended.

Moreover, if the determination is negative in step S619, then in S624 the tray motor 201 is driven to start lowering the tray 101, and the tray 101 will be lowered until it is detected in step S625 that the tray 101 is at the second elevated position. If the determination is affirmative in step S625, the driving of the tray motor 201 is stopped in step S626, and the flow from S601 and thereafter will be performed again.

Moreover, if the determination is negative in step S617, then in S627 the tray motor 201 is driven to start lifting the tray 101, and the tray 101 will be lifted until it is detected in step S628 that the tray 101 is at the second elevated position. If the determination is affirmative in step S628, the driving of the tray motor 201 is stopped instep S629, and the flow from S601 and thereafter will be performed again.

With the above configuration and control, in this feeding apparatus, the elevated position is moved to the optimum feed position while always monitoring the sheet feeding state, so that a stable feed operation can be performed. Thus, the possibility of feed troubles, such as double feed and/or misfeed, can be suppressed.

Third Embodiment

Hereinafter, a third embodiment of the present invention will be explained with reference to the drawings. Note that a part having the same configuration as the above-described first embodiment is given the same reference sign to omit the explanation thereof.

Figure 10:
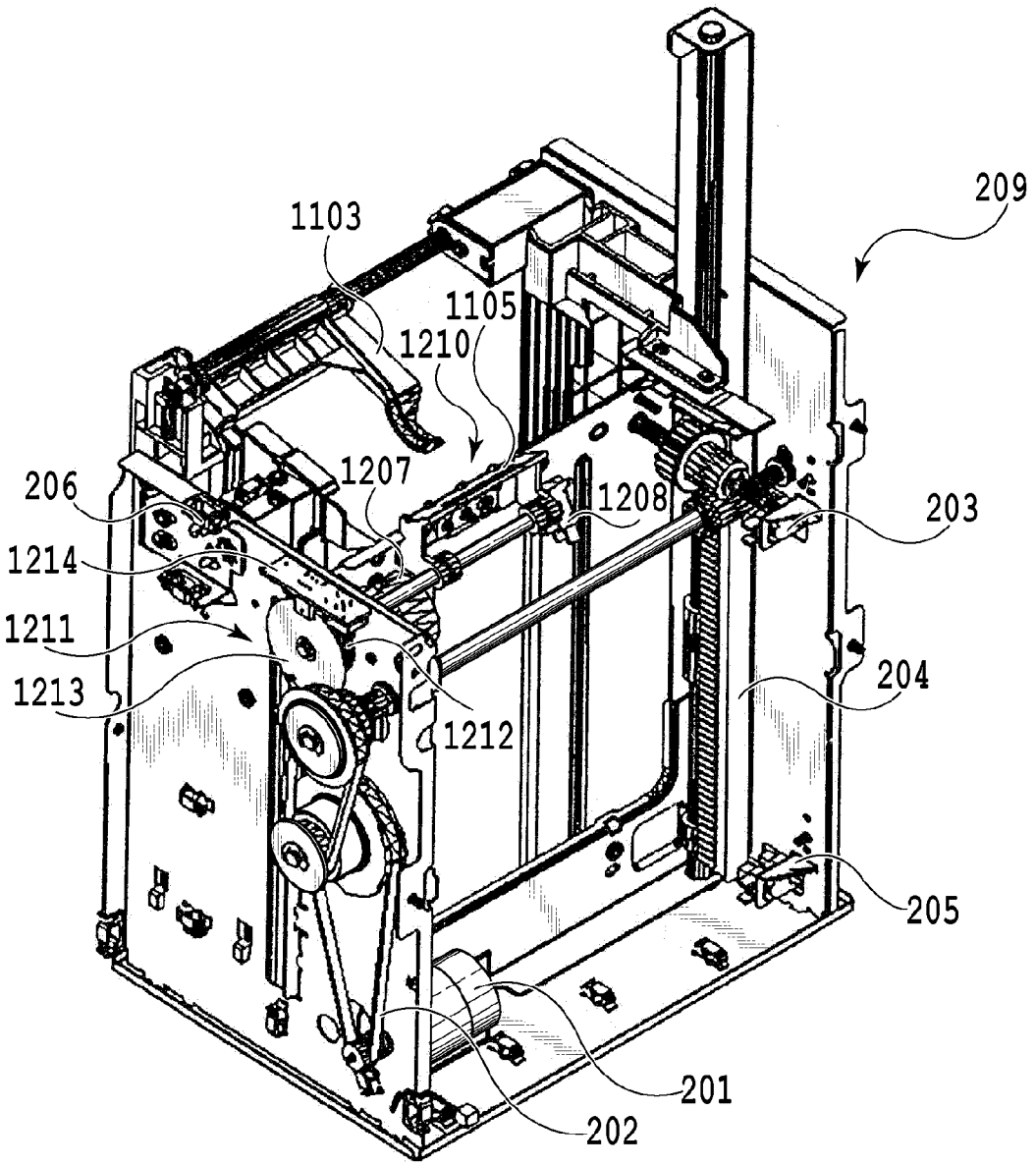
FIG. 10 illustrates the configuration of a feeding apparatus applicable in a feeding apparatus according to a third embodiment.

FIG. 10 illustrates the configuration of a feeding apparatus to which the present embodiment can be applied.

In the present embodiment, a separation/rotation unit 1210 is provided, and includes a separation drive transmission part 1212 which transmits the drive from a separation motor which is the drive source of the separation/rotation operation. The angle of a separation unit 1105 (described later) varies with the rotation direction of a separation motor 1207. Moreover, the separation/rotation unit 1210 is configured so as to operate in accordance with an instruction from the control apparatus 502 (described later), with a predetermined-position detection unit 1208 which detects a predetermined position of the separation/rotation unit 1210 as a point of origin.

The separation/rotation unit 1210 includes a sheet surface lever 1103 which abuts to the uppermost sheet or the top face of the tray 101 and vertically rotates in order to detect the top-face position of a sheet bundle placed on the tray 101 or the top-face position of the tray 101 having no sheet placed thereon.

Moreover, in the present embodiment, a separation/rotation amount detection unit 1211 configured to detect the rotation amount of the separation/rotation unit 1210 is provided, and this separation/rotation amount detection unit 1211 includes a rotary encoder 1213 arranged in connection to the separation drive transmission part 1212. Then, the rotation amount of the separation unit 1105 is detected, based on the detection result of a detection unit 1214 configured to detect the rotation amount of the separation unit 1105 by detecting the rotation amount of the rotary encoder 1213. Furthermore, the control apparatus 502 manages the angle of the separation unit 1105, based on the detection result of the predetermined-position detection unit 1208 and the detection result of the encoder detection unit 1214. Note that, the detection units 1211 and 1214 specific to the present embodiment are connected to a control unit having a basic configuration similar to FIG. 5, and the detected information is provided for the control of the separation/rotation unit 1210 and separation unit 1105 which are the control targets.

Figures 11, 11A:
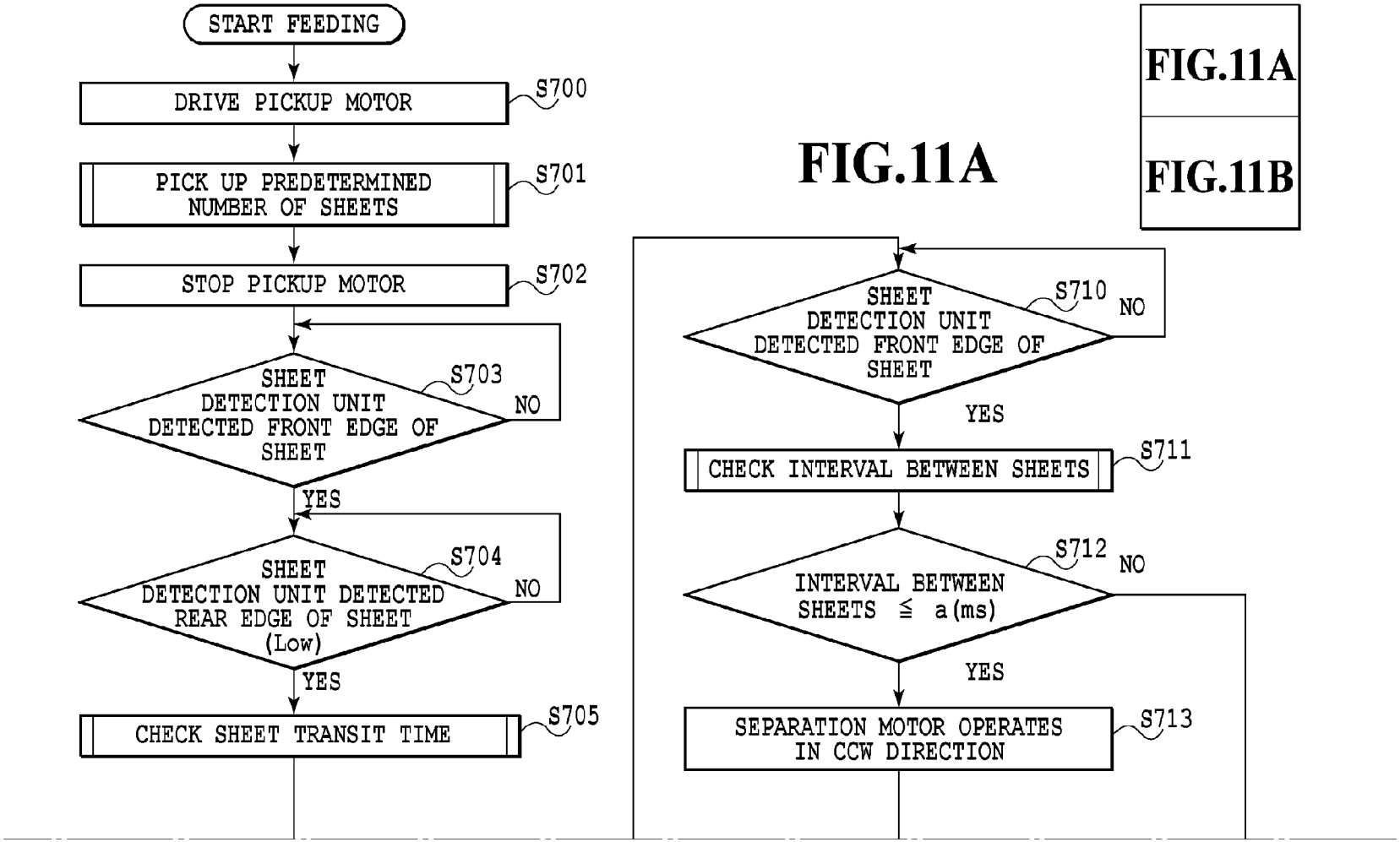
FIG. 11 is a diagram showing the relationship of FIG. 11A and FIG. 11B.
FIG. 11A is a flow chart illustrating feed processing in the feeding apparatus according to the third embodiment.
Figure 11B:
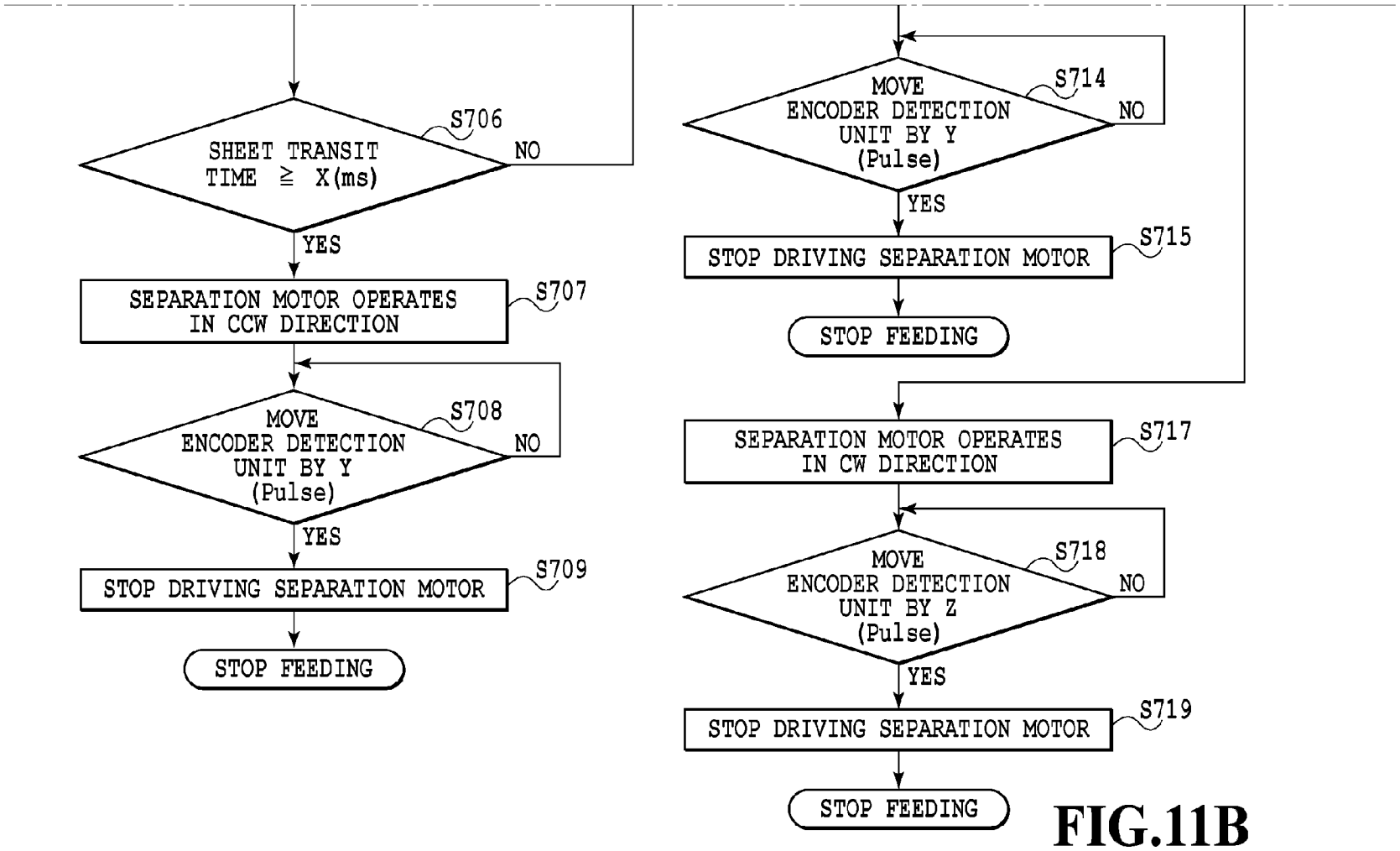
FIG. 11B is a flow chart illustrating feed processing in the feeding apparatus according to the third embodiment.

FIG. 11A and FIG. 11B are flow charts illustrating the feed processing in the feeding apparatus of the present embodiment. Hereinafter, the characteristic feed processing of the present invention will be explained using this flow chart. Once the feed processing is started after the control apparatus 502 received a feed execution instruction transmitted from the host PC 501, in step S700 the control apparatus 502 causes the pickup motor 303 to be driven and links the clutch 504. Then, in step S701, a sheet is fed. In feeding the second sheet and subsequent sheets, the control apparatus 502 controls the pickup motor 303 and clutch 504 so as to be able to start feeding the sheets a predetermined time after the sheet detection sensor 106 detects a rear edge of the previous sheet. The control apparatus 502 causes the pickup motor 303 to rotate by a predetermined number of rotations corresponding to a distance when a front edge of a sheet passes the position where sheets are separated by the separation/feed unit 102. Then, in step S702, the clutch 504 is released to stop the pickup roller 104 and stop the pickup motor 303.

Subsequently, in step S703, it is checked whether or not the sheet detection sensor 106 has detected a front edge of a sheet, and this check will be repeatedly performed until the sheet detection sensor 106 detects this edge, and if a front edge of the sheet is detected, the flow transitions to step S704. In step S704, it is checked whether or not the sheet detection sensor 106 has detected a rear edge of the sheet, and the check will be repeatedly performed until the sheet detection sensor 106 detects this edge, and if a rear edge of the sheet is detected, the flow transitions to step S705. In step S705, the transit time of a sheet is checked by the control apparatus 502. That is, the control apparatus 502 checks (obtains) a time elapsed after the sheet detection sensor 106 detected a front edge of a sheet and until it detects a rear edge of the sheet.

In step S706, the separation state of the sheet is determined by the control apparatus 502. That is, based on whether or not the sheet transit time checked in step S705 is equal to or greater than the predetermined time X, it is determined whether or not the sheet has been normally separated. Note that, the predetermined time X in comparing the sheet transit time with the predetermined time X is set by adding values, such as a feeding error and a measurement error, to a value obtained by dividing a length of a sheet in the feeding direction by the feeding speed of a sheet to be fed. When the sheet transit time is equal to or greater than the predetermined time X (transit time≥X), a rear edge of a preceding sheet and a front edge of the subsequent sheet overlap, and the sheet detection sensor 106 will continue to indicate the presence of a sheet. Therefore, it is possible to determine that sheet separation is insufficient. Then, the control apparatus 502 determines that this is a double-fed state, and stops the pickup motor 303 and reports the occurrence of double feed to the host PC 501.

Subsequently, in step S707, the separation motor 1207 is driven so as to rotate counterclockwise (CCW), and then in step S708 the separation unit 1105 is rotationally moved until the encoder detection unit 1214 detects a predetermined rotation amount Y. Upon detection of the predetermined rotation amount, in step S709 the control apparatus 502 stops the separation motor 1207 to end the feed operation.

When in step S706 the sheet transit time is less than the predetermined time X, the flow transitions to step S710 and it is checked whether or not the sheet detection sensor 106 has detected a front edge of a sheet, and the check will be repeatedly performed until the sheet detection sensor 106 detects this edge, and if a front edge of the sheet is detected, the flow transitions to step S711. In step S711, the interval between a preceding sheet and the subsequent sheet is checked. That is, checked is a time elapsed after the sheet detection sensor 106 detected a rear edge of the preceding sheet and until it detects a front edge of the subsequent sheet. Subsequently, in step S712, it is checked whether the interval between the sheets is equal to or less than a predetermined time "a".

When the sheet interval is equal to or less than the predetermined time "a" (sheet interval ≤a), the control apparatus 502 determines that the interval between a preceding sheet and the subsequent sheet is narrow and thus the sheet separation is insufficient, and that the loads on the front edge of a sheet and on the inclined part of the separation unit 1105 have decreased and thus double feed is likely to occur. Accordingly, if the interval between sheets is equal to or less than the predetermined time "a", then the flow transitions to step S713, in which the separation motor 1207 is driven so as to rotate counterclockwise (CCW). Then, in step S714, the separation unit 1105 is rotationally moved until the encoder detection unit 1214 detects a predetermined rotation amount Y. Upon detection of the predetermined rotation amount Y, in step S715 the control apparatus 502 stops the separation motor 207 to end the feed operation.

In step S712, if the interval between sheets is greater than the predetermined time "a" (sheet interval >a), the control apparatus 502 determines that the interval between a preceding sheet and the subsequent sheet is wide, and that the loads on the front edge of a sheet and on the inclined part of the separation unit 1105 have increased and thus misfeed is likely to occur. Then, if the interval between sheets is greater than the predetermined time "a", the flow transitions from step S712 to step S717, in which the separation motor 1207 is driven so as to rotate clockwise (CW). Then, in step S718, the separation unit 1105 is rotationally moved until the encoder detection unit 1214 detects a predetermined rotation amount Z. Upon detection of the predetermined rotation amount Z, in step S719 the control apparatus 502 stops the separation motor 1207 to end the feed operation.

Figure 12A:
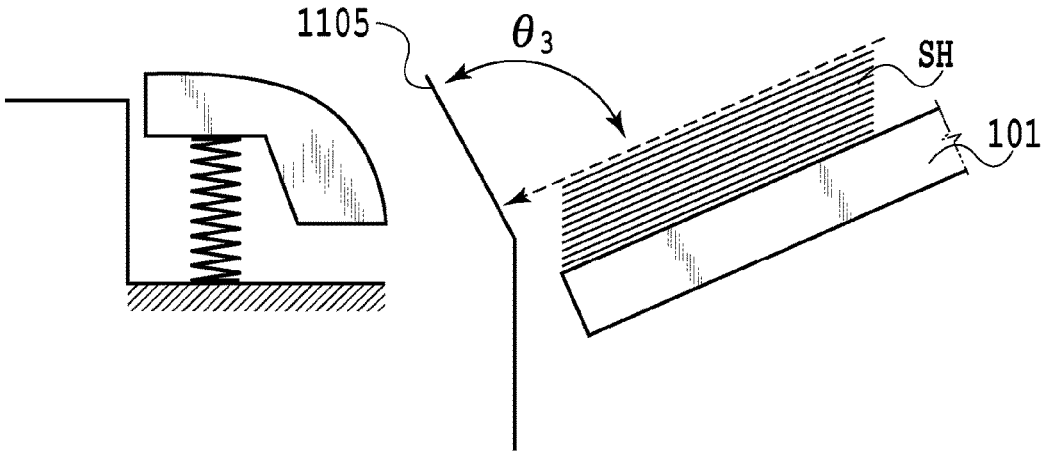
FIG. 12A illustrates a relationship between the angle of a separation unit and a sheet entry angle in a feeding apparatus.
Figure 12B:
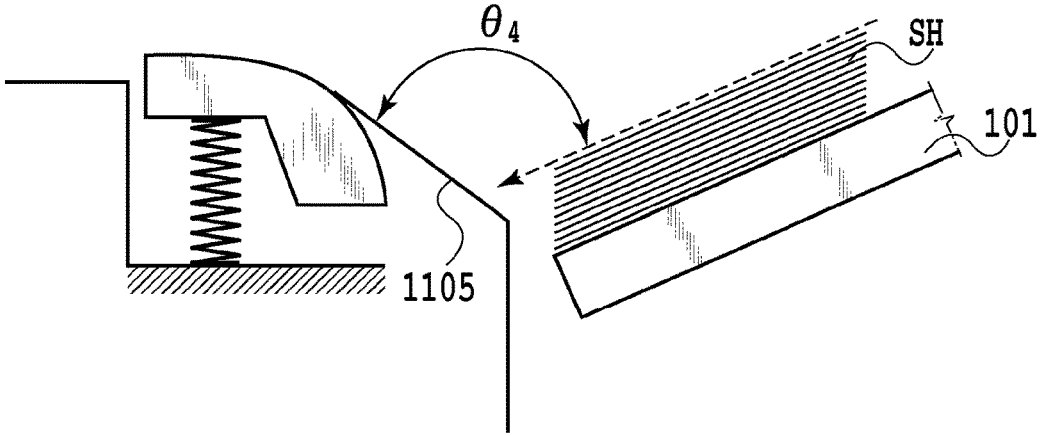
FIG. 12B illustrates a relationship between the angle of a separation unit and a sheet entry angle in a feeding apparatus.

FIG. 12A and FIG. 12B illustrate a relationship between the angle of the separation unit 1105 and a sheet entry angle. When the separation unit 1105 is rotationally moved from an initial position toward a direction in which a relative angle θ3 between the separation unit 1105 and the tray 101 becomes acute as illustrated in FIG. 12A, the reaction force which a front edge of a sheet receives from the inclined part of the separation unit 1105 will increase. As the result, the effect of separating sheets will improve. Thus, the occurrence of double feed can be suppressed.

When the separation unit 1105 is rotationally moved from an initial position toward a direction in which a relative angle θ4 between the separation unit 1105 and the tray 101 becomes obtuse as illustrated in FIG. 12B, the reaction force which a front edge of a sheet receives from the inclined part of the separation unit 1105 will decrease. As the result, the load on the inclined part of the separation unit 1105 decreases. Thus, the occurrence of misfeed can be suppressed.

With the above configuration and control, in the feeding apparatus of the present embodiment, the sheet feeding state is always monitored by detecting the interval between sheets and the feed operation corresponding to the feeding state is performed, so that the possibility of feed troubles, such as double feed and/or misfeed, can be suppressed.

Note that, in the present embodiment, the entry angle of a front edge of a sheet to the inclined part of the separation unit 1105 is changed by changing the angle of the separation unit 1105, but not limited thereto. That is, the entry angle of a front edge of a sheet to the inclined part of the separation unit 1105 may be changed by changing the angle of the tray 101. In this case, the change unit of the present invention includes the inclined part which is the separation unit, a tray angle change unit, and the tray.

Moreover, the entry angle maybe changed to an angle corresponding to the individual information, such as the type and quality of material of a sheet.

Furthermore, when the feed troubles cannot be suppressed even if the angle of the separation unit is changed, the height of the tray may be changed.

As described above, according to the sheet feeding apparatus of the present embodiment, the feeding state of a sheet is checked, and based on this feeding state, the relative angle between the separation unit 1105 and the tray 101 is changed, thereby switching a state in which the sheet separation effect is high and a state in which the load on the inclined part of the separation unit is low. Thus, a sheet feeding apparatus and printing apparatus capable of suppressing the occurrences of double feed and/or misfeed of a sheet can be realized.

Others

Note that, the present invention is not limited to the above-described various embodiments and variants, but appropriate variants, modifications, and alternatives are possible.

For example, in each of the above-described embodiments, the entry angle of the separation unit to the inclined part is changed by changing the position of the tray to a position corresponding to the angle of each of the separation units, but not limited thereto. For example, the entry angle of a front edge of a sheet to the inclined part of the separation unit may be changed by supporting, at the second elevated position, the tray so as to be able to change the angle of the tray so that the angle of the tray relative to the stacked sheets becomes smaller than that at the first elevated position. Moreover, in the above-described embodiments, two inclined parts each having different angles are provided, but not limited to two, and two or more a inclined parts may be provided. Furthermore, by providing a plurality of inclined parts each having different friction coefficients against a sheet instead of providing the inclined parts each having different angles, a different reaction force may be effected in response to contacting of an inclined sheet, or a configuration having the inclined parts each having different angles and a configuration having the inclined parts each having different friction coefficients may be combined.

Moreover, in the above-described second embodiment, the separation state is determined based on the transit time of a sheet, but not limited thereto. For example, with the use of a sheet detection sensor in the downstream of the separation unit, a time elapsed after picking up by the pickup roller and until the sheet detection sensor detects a sheet may be measured, and then a separation state may be determined based on this time.

As described above, according to the sheet feeding apparatus of the present embodiment, the elevated position of a stacking unit can be changed based on the result of the sheet determining unit. Moreover, a front edge of a sheet is caused to abut to an inclined part which provides the optimum resistance in accordance with the type of the sheet, so that stable feed can be performed without being limited to the state and/or type of a sheet and without causing an increase in cost and/or an increase in size of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-205844 filed Oct. 20, 2016, and No. 2017-046650 filed Mar. 10, 2017, which are hereby incorporated by reference herein in their entirety.

What is claimed is:

1. A sheet feeding apparatus comprising:

a stacking unit capable of stacking sheets;

a feed unit configured to feed an uppermost sheet of the sheets stacked on the stacking unit by a feeding roller;

a separation unit configured to separate the uppermost sheet of the stacked sheets, wherein the separation unit includes a first separation portion and a second separation portion, which is provided upstream of the first separation portion with respect to a conveying direction of the sheet by the feed unit, and which has a greater separation action on the sheet than that of the first separation portion;

a change unit for changing the position of the stacking unit, wherein the position of the stacking unit for bringing the sheet fed by the feed unit into contact with the first separation portion without bringing the sheet into contact with the second separation portion is defined as a first position, the position of the stacking unit for bringing the sheet fed by the feed unit into contact with the second separation portion is defined as a second position, and the change unit selects the position of the stacking unit from a plurality of positions including the first position and the second positions;

a detection lever which contacts the uppermost sheet and moves according to the position of the uppermost sheet, wherein in a case where the stacking unit is in either one of the first position or the second position, a position at which the uppermost sheet and the detection lever abut each other is downstream, with respect to a conveying direction, of a position where the uppermost sheet and the feeding roller abut each other;

a position detection unit configured to detect the position of the detection lever; and a control unit configured to change the position of the stacking unit by the change unit based on a detection result of the position detection unit.

2. The sheet feeding apparatus according to claim 1, wherein the first separation portion and the second separation portion are inclined at different angles, respectively, and an angle formed by the first separation portion and a sheet stacking surface of the stacking unit is smaller than an angle formed by the second separation portion and the sheet stacking surface of the stacking unit.

3. The sheet feeding apparatus according to claim 1, wherein the first separation portion and the second separation portion have different friction coefficients for the sheet.

4. The sheet feeding apparatus according to claim 1, wherein the change unit lifts the stacking unit to thereby move a sheet stacked on the stacking unit to a feed position to which the sheet can be fed by the feed unit.

5. The sheet feeding apparatus according to claim 1, wherein the change unit includes an angle change unit configured to change an inclination angle of the stacking unit, and changes the inclination angle of the stacking unit to an angle corresponding to a changed sheet.

6. The sheet feeding apparatus according to claim 1, further comprising a sheet type determining unit configured to determine a type of the sheet, wherein the change unit selectively causes the sheet to firstly abut the first separation portion or the second separation portion in accordance with the type of the sheet determined by the sheet type determining unit.

7. The sheet feeding apparatus according to claim 6, wherein the sheet type determining unit further includes a basis weight detection unit for determining the basis weight of the sheet, and wherein the change unit changes the position of the stacking unit so that in a case where the determined basis weight is equal to or less than a predetermined value, the sheet firstly abuts the first separation portion and so that in a case where the determined basis weight is greater than the predetermined value, the sheet firstly abuts the second separation portion.

8. The sheet feeding apparatus according to claim 6, further comprising an input unit configured to input information about the sheet, wherein the sheet type determining unit determines the type of the sheet in accordance with the information about the sheet input to the input unit.

9. The sheet feeding apparatus according to claim 1, further comprising a separation state determining unit configured to determine a separation state of a sheet by the separation unit, wherein according to the determination result of the separation state determining unit, the change unit selectively causes the sheet to firstly abut the first separation portion or the second separation portion.

10. The sheet feeding apparatus according to claim 9, wherein the separation state determining unit further includes a measurement unit configured to measure an interval between a preceding sheet fed earlier and a subsequent sheet fed subsequently, and wherein the change unit changes the position of the stacking unit so that in a case where the determined interval is equal to or less than a predetermined value, the sheet firstly abuts the first separation portion, and in a case where the determined interval is greater than the predetermined value, the sheet firstly abuts the second separating portion.

11. A printing apparatus comprising:

a sheet feeding apparatus according to claim 1; and a printing unit configured to print onto the sheet fed by the sheet feeding apparatus.

12. A sheet feeding apparatus comprising:

a stacking unit capable of stacking sheets;

a feed unit configured to feed an uppermost sheet of the sheets stacked on the stacking unit by a feeding roller;

a separation unit configured to separate the uppermost sheet of the sheets, wherein the separation unit includes a first separation portion and a second separation portion, which is provided upstream of the first separation portion with respect to a conveying direction of the sheet by the feed unit, and which has a greater separation action on the sheet than that of the first separation portion;

a thickness obtaining unit for obtaining information on the thickness of the sheet; and a change unit for changing the position of the stacking unit, wherein the position of the stacking unit for bringing the sheet fed by the feed unit into contact with the first separation portion without bringing the sheet into contact with the second separation portion is defined as a first position, the position of the stacking unit for bringing the sheet fed by the feed unit into contact with the second separation portion is defined as a second position, and the change unit selects the position of the stacking unit from a plurality of positions including the first position and the second position based on the information on the thickness obtained by the thickness obtaining unit;

a detection lever which contacts the uppermost sheet and moves according to the position of the uppermost sheet, wherein in a case where the stacking unit is in either one of the first position or the second position, a position at which the uppermost sheet and the detection lever abut each other is downstream, with respect to a conveying direction, of a position where the uppermost sheet and the feeding roller abut each other;

a position detection unit configured to detect the position of the detection lever; and a control unit configured to change the position of the stacking unit by the change unit based on a detection result of the position detection unit.

* * * * *